US010167669B1

(12) United States Patent
Otenbaker

(10) Patent No.: US 10,167,669 B1
(45) Date of Patent: Jan. 1, 2019

(54) LADDER SHELF SYSTEM

(71) Applicant: James T. Otenbaker, Inverness, FL (US)

(72) Inventor: James T. Otenbaker, Inverness, FL (US)

( * ) Notice: Subject to any disclaimer, the term of this patent is extended or adjusted under 35 U.S.C. 154(b) by 0 days.

(21) Appl. No.: 15/873,004

(22) Filed: Jan. 17, 2018

(51) Int. Cl.
*E06C 7/14* (2006.01)

(52) U.S. Cl.
CPC ..... *E06C 7/14* (2013.01)

(58) Field of Classification Search
CPC ..... E06C 7/00; E06C 7/14
USPC ..... 248/210, 211, 110, 311.2, 315; 182/121
See application file for complete search history.

(56) References Cited

U.S. PATENT DOCUMENTS 2,308,180 A 1/1943 Larsen et al.
3,223,369 A 12/1965 Benninger
3,980,264 A * 9/1976 Tomasik ..... E06C 7/14 248/210
4,211,307 A 7/1980 Ethridge
4,653,608 A 3/1987 Casada
4,852,759 A * 8/1989 Williams ..... B44D 3/128 220/571.1
5,079,795 A * 1/1992 Schmid ..... B44D 3/126 15/257.06
5,390,888 A 2/1995 Rogers
6,783,103 B2 * 8/2004 Salani ..... E06C 7/143 248/210

* cited by examiner

*Primary Examiner* — Todd M Epps
(74) *Attorney, Agent, or Firm* — Patent CEO, LLC; Phillip Vales

(57) ABSTRACT

A Ladder Shelf System has a paint can retainer that has attachment slots for a painting device tray at its bottom portion. The painting device tray when reverse attached to the paint can retainer serves a support for the placement of a paint tray legs in slots of the painting device tray. A ladder is held to the paint can retainer using a dual member holder where each member thereof is held to an opposite side of the paint can retainer. Cutouts in the paint can retainer hold the wire holder of a paint can as necessary.

20 Claims, 6 Drawing Sheets

LADDER SHELF SYSTEM

FIELD OF THE INVENTION

The present invention relates to an accessory utilized on a ladder. More particularly, the present invention relates to a device capable of holding a paint can whilst removably attached to a ladder and optionally holding useful tools on an attached tray.

BACKGROUND OF THE INVENTION

There exist in the prior art various different types of ladders in existence including the ubiquitous step and extension ladders. Typically, a basic ladder is formed by two longitudinal members, a first member and a second member, being welded together through the use of a plurality of transverse steps or rungs. Each step has a first and second edge thereof that are in their turn respectively welded to, bolted on or otherwise permanently attached to the first member and the second member. Thus, the first edge of each step is attached to the first member and the second edge of each step is attached to the second member. Of course, each step is disposed parallel to the adjacent ones to form a convenient pathway for users.

Ladders come in many varieties and the basic one described previously has been modified to produce what is known as an extension ladder; this type of ladder, as its name implies, is designed to extend the length of the basic ladder. In order to accomplish this goal, the basic ladder is modified to include an additional ladder adjacent to the basic ladder that smoothly slides along a guideway as follows.

Typically, the extension ladder has a first and second ladder that moveably engage one another by having dual corresponding longitudinal lips on either side of both ladders thus facilitating the motion of the ladders thereupon. Additionally, the use of a hook restriction mechanism attached to one ladder and extending about the second ladder prevents the second ladder from disengaging therefrom. Various other devices are included in this type of ladder including stops, rope extension assistance and many more; however, most particularly, this type of ladder does not usually come with a shelf built into either ladder.

Another type of ladder has a basic ladder attached to a support mechanism of similar size. The support mechanism generally has no steps per se, and is attached to the top of the basic ladder using pins that permit axial movement thereupon. Additionally, a restricting device is attached to both the basic ladder and the support mechanism about midway down the length of both the support mechanism and the basic ladder. The restricting device thereby forbids the basic ladder from moving away from the support mechanism beyond a certain distance and as a result this is presentable as an 'A' frame.

Whilst these ladders have proven themselves useful in many fields, it is very clear that many ladders have no mechanism whatsoever to support various useful items thereon. Therefore, users are forced to carry the items themselves in clothing pockets or within utility belts designed with various compartments suitable for this purpose. Amongst these items are electric battery operated tools such as drills, saws, work lights, and similar devices, as well as paintbrushes, paint cans of various sizes, screwdrivers, hammers, cloths, tape and many more. As the user swaps out tools, it becomes nearly impossible to work with a continuous switching out of items as needed.

Thus, there needs to be a solution that facilitates the laying out of various useful items as a user transits up and down a ladder and as he or she is working upon a particular step(s). Further, there needs to be a solution that accommodates various types of ladder sizes, and shapes. The solution should also be simple to deploy in the field when a user temporarily attaches it to a ladder. Further, it should be useable whilst attached thereto and easy to remove therefrom and stored for later use as necessary.

Accordingly, there needs to be some solution to overcome the aforementioned problems.

SUMMARY OF THE INVENTION

The present invention overcomes the deficiencies of the known art and the problems that remain unsolved by providing a Ladder Shelf System in various embodiments.

A carrying instrument comprising:

a paint can retainer having a work surface;

a first surface;

a second surface; wherein the first surface and second surface integrate with the work surface such that they are on opposite sides of the work surface;

a bottom surface integral with the work surface along a bottom edge of the work surface; wherein the bottom surface is integral with a first edge of the first surface and the bottom surface is integral with a second edge of the second surface;

such that a paint can space is formed between the first surface, the second surface, the work surface and the bottom surface; and wherein the work surface, bottom surface, first surface and the second surface partially enclose the paint can space;

a ladder holder attached thereto.

In another aspect, further comprising:

a first tray removably attached to the bottom surface of the retainer; wherein the tray has a plurality of sides and a floor such that the plurality of sides are disposed about the floor forming a carrying space between the sides and atop the floor and wherein the floor of the tray is removably attached to the bottom surface.

In another aspect, further comprising:

a second paint tray first leg slot in the first tray.

In another aspect, further comprising:

a second paint tray second leg slot in the first tray.

In another aspect, wherein the paint can retainer further comprises:

a first cord attachment slot in the first surface.

In another aspect, wherein the paint can retainer further comprises:

a second cord attachment slot in the second surface.

In another aspect, wherein the ladder holder further comprises:

a first L shaped member having a first retainer attachment point removably attached to the first surface of the retainer using the first retainer attachment point.

In another aspect, wherein the ladder holder further comprises:

a second L shaped member having a second retainer attachment point removably attached to the second surface of the retainer using the second retainer attachment point.

In another aspect, wherein the ladder holder further comprises:

the first L shaped member cooperating with the second L shaped member along an indentation near an end of a leg of the first L shaped member such that a bottom edge of the second L shaped member sits within the indentation.

In another aspect, wherein the ladder holder further comprises:

is attached to the first surface and the second surface such that a ladder holding space is formed between the ladder holder and the back of the working surface.

In another aspect, wherein the ladder holder further comprises:

a first member removably attached to the first surface; and a second member removably attached to the second surface so that the first member and the second member cooperate together wherein the first member has a curved ladder edge.

In another aspect, wherein the second member further comprises:

a first member having an integral first slotted piece and an integral engagement portion wherein the engagement portion has a hook for gripping:

a second member having a second slotted piece and another piece of material.

In another aspect, wherein the paint can retainer further comprises:

a first paint can wire cutout at a top of the first surface.

In another aspect, wherein the paint can retainer further comprises:

a second paint can wire cutout at a top of the second surface.

A painting portability system comprises:

a first holder attachment point in a first surface;

a second holder attachment point in a second surface;

a working surface integral with the first surface and with the second surface, wherein the first surface and the second surface are on opposite sides of the working surface;

a bottom surface integral with the first surface, the second surface and the working surface; and a ladder holder attached at the first holder attachment point and the second attachment point such that a ladder holding space is formed between a back of the working surface and the ladder holder, and wherein the first surface, the second surface, the bottom surface and the working surface are distinct from the ladder holder.

In another aspect, wherein the ladder holder further comprises:

a curved ladder top portion.

A painting carriage device comprising:

a paint can supporting retainer having:

a ladder gripping holder attached to a first surface and to a second surface of the retainer;

such that the first surface and the second surface are opposite one another and integral with a bottom surface along corresponding edges of the first surface with the bottom surface and of the second surface with the bottom surface; and wherein the first surface and the second surface are integral with a working surface along edges of: the first surface with the working surface, and of the second surface with the working surface;

wherein the bottom surface and the working surface are integral along a common edge such that a paint can space is formed between a front of the working surface and a top of the the bottom surface, and the paint can space is formed between the first surface and the second surface and atop the bottom surface; and wherein the working surface, bottom surface, first surface and the second surface partially enclose the paint can space.

In another aspect, further comprising:

a support tray having a plurality of sides attached front to end one after another and wherein each of the plurality of sides is attached to a floor such that the floor is directly attached to the bottom surface of the paint can supporting retainer.

In another aspect, further comprising:

a paint tray leg first slot in the support tray such that the support tray when inverted is attached at the bottom of the support tray floor with a bottom surface of the retainer.

In another aspect, further comprising:

a paint can wire cutout in the first surface.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
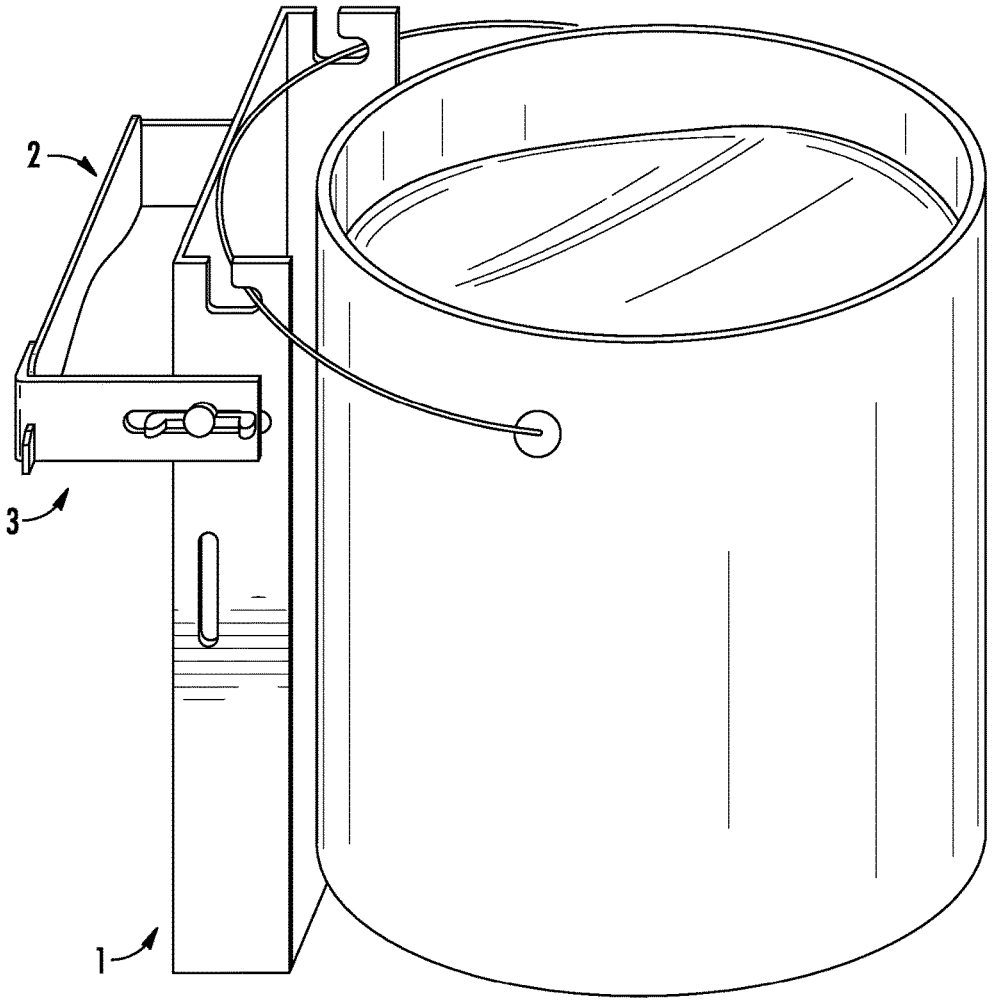
FIG. 1 presents a Ladder Shelf System holding a one gallon paint can in an embodiment disclosed herein.

FIG. 1 presents a Ladder Shelf System holding a one gallon paint can in an embodiment disclosed herein. A Ladder Shelf System is shown in the figure having a retainer 1, a first clip 2 and a second clip 3. The first 2 and second 3 clips are attached to the rectangular side surfaces of the retainer 1 using bolts and wing nuts as described more fully below. It should be first understood, however, that in operation the longitudinal ladder member would be situated between the back of the working surface of the retainer 1 and the two clips 2, 3 as they are engaged together. Thus, a one gallon paint can be placed atop a bottom surface of the retainer 1 whilst the wire grip of the one gallon paint can is held in place by the retainer using cutouts in the flanged rectangular surfaces at the top of the retainer 1. This is to be discussed more fully as described below.

Figure 2:
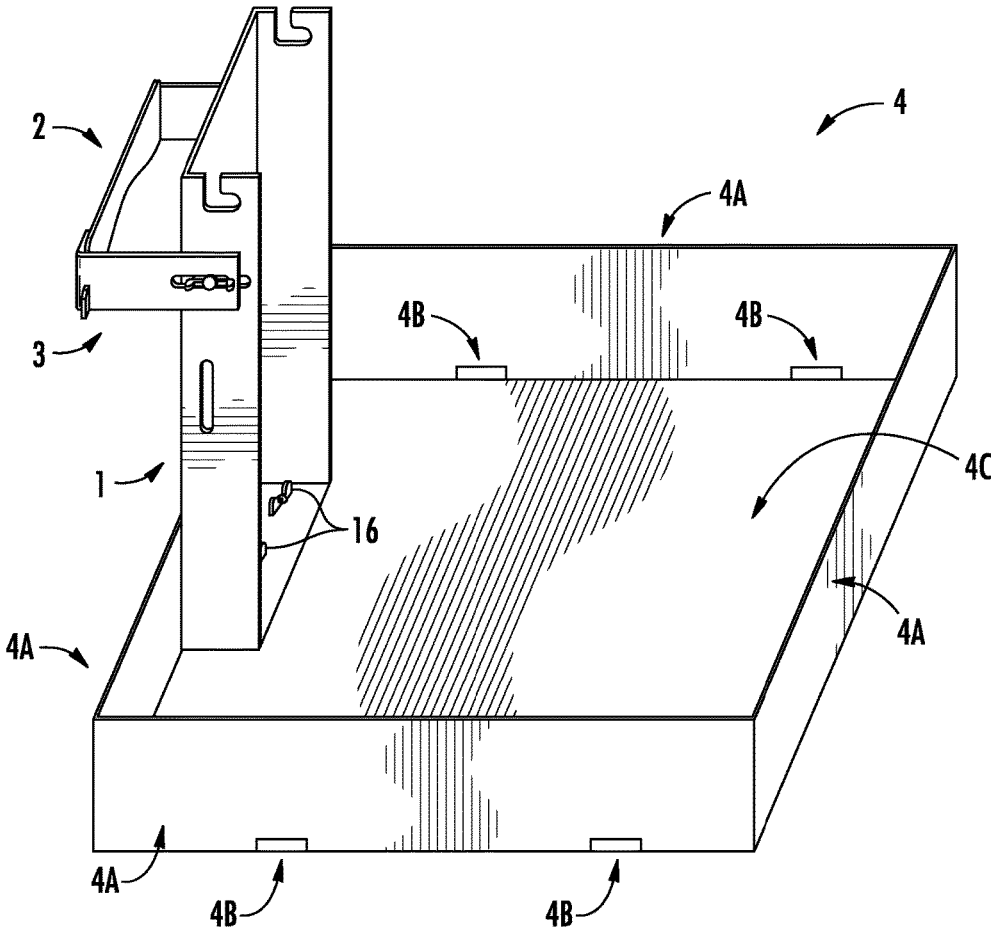
FIG. 2 presents a Ladder Shelf System having a tray in an alternative embodiment disclosed herein.

FIG. 2 presents a Ladder Shelf System having a tray in an alternative embodiment disclosed herein. The Ladder Shelf System having a retainer 1, first clip 2, and second clip 3 is attached to a tray 4. The retainer 1 has two slots in its bottom surface that are used to insert two bolts therein and on into corresponding holes in the floor 4C of the tray 4 and along with wing nuts finishing the connection; of course, the bolts could be inserted first through the floor 4C holes, then into the slots at the bottom surface of the retainer 1 and attached with wing nuts.

The tray itself has four sides 4A, four cutouts 4B and a floor 4C. Each of the sides 4A is a rectangular surface that integrates along a forward edge with a rear edge of a next side 4A; each of the sides also integrates at a rear edge with the forward edge of a previous side 4A. Then each of the sides 4A has a bottom edge that integrates along an edge of a rectangular or square floor 4C thereby completing the tray 4. Thus, a space is formed atop the floor 4C and between the four sides 4A to carry various items. Finally, the dual cutouts 4B are disposed two to an intersection between a side 4A and the floor 4C; further, the first set of dual cutouts is disposed opposite the second dual cutouts. It should be understood that these cutouts 4B are used to attach a paint tray thereto when in an inverted configuration as shown in FIG. 3.

Figure 3:
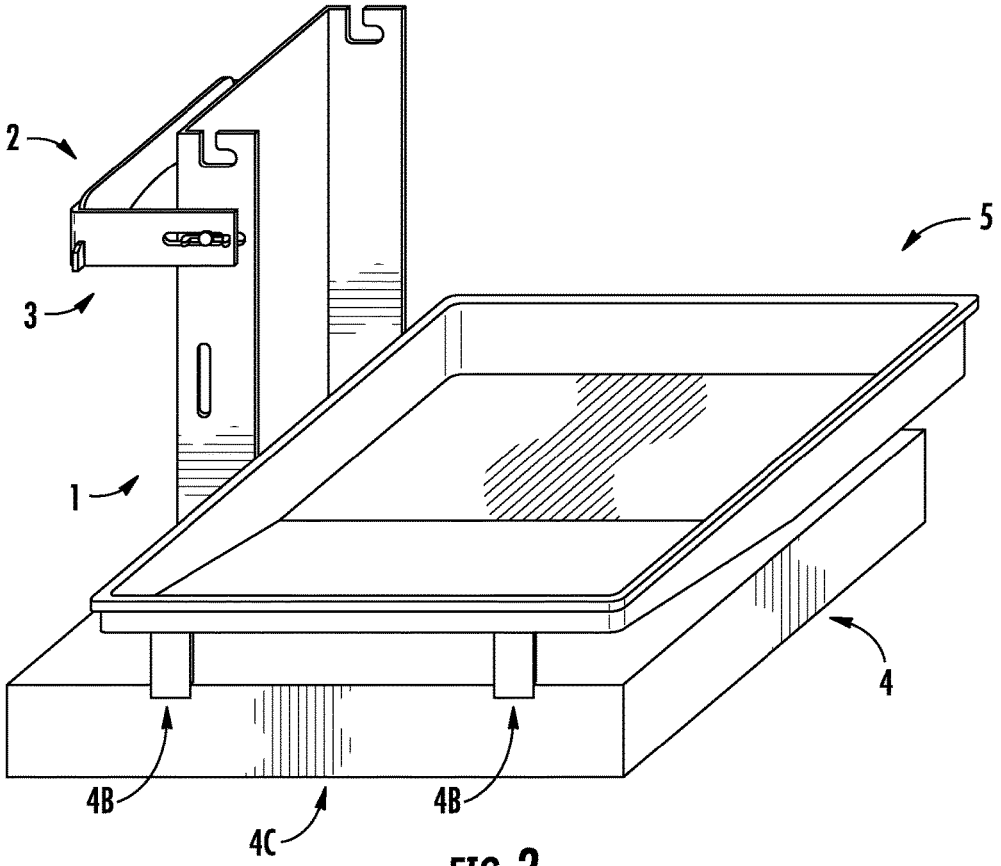
FIG. 3 presents a Ladder Shelf System having an inverted tray in another alternative embodiment disclosed herein.

FIG. 3 presents a Ladder Shelf System having an inverted tray in another alternative embodiment disclosed herein. The Ladders Shelf System including retainer 1, first clip 2, and second clip 3 is attached to the underside surface of the floor 4C. The bottom of the retainer 1 has slots that in combination with holes in the inverted floor 4C form an attachment point for a bolt wing combination thereby completing the attachment thereto. The tray 4 is inverted so that the cutouts 4B are at their highest point for attachment of a paint tray 5 thereto; this is accomplished because the paint tray 5 has two legs which slide into these cutouts providing an anchor for the tray to the underside of the tray 4.

Figure 4A:
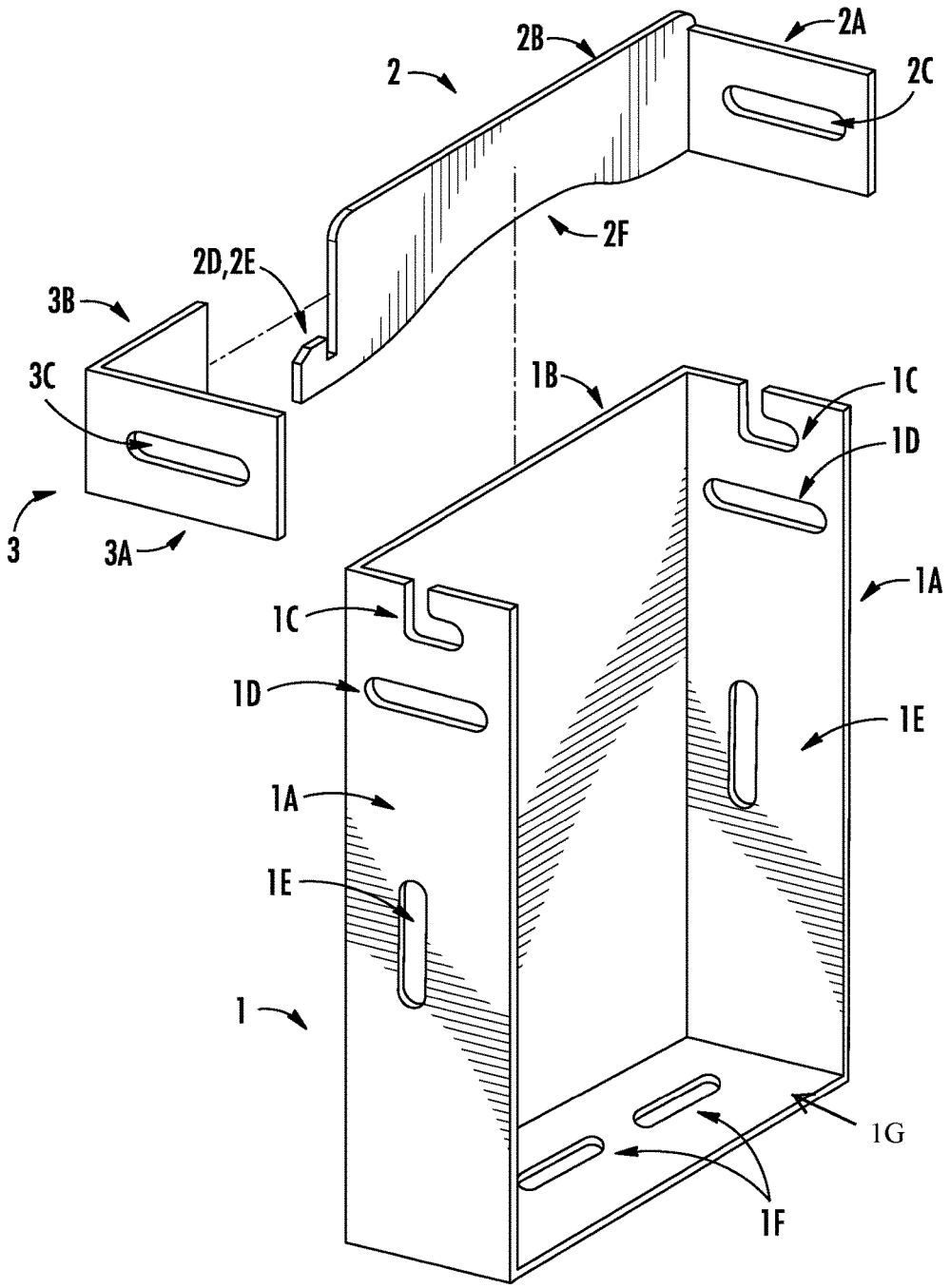
FIG. 4A presents the various components of a Ladder Shelf System in an embodiment disclosed herein.

FIG. 4A presents the various components of a Ladder Shelf System in an embodiment disclosed herein. FIG. 4C presents a left side view of a retainer 1 as taught in an embodiment of the Ladder Shelf System disclosed herein. The retainer 1 has two opposing flanged rectangular surfaces 1A that are parallel to each other and each have an edge integrating with a work surface 1B along corresponding opposing edges thereof. The flanged rectangular surfaces 1A are disposed so that they approximate or they are at a right angle with the work surface 1B. The work surface 1B has a front and a back where the front is that portion that faces between the two flanged rectangular surfaces 1A and the back is that part that faces the first clip 2 and the second clip 3. Between the back of the working surface 1B and the first clip 2 and the second clip 3 is formed a space wherein a longitudinal member (holds the rungs together) of ladder is placed as the first clip 2 and second clip 3 are attached to the retainer 1. This space is shown in FIG. 1, 2, 3.

The flanged rectangular surfaces 1A integrate with a bottom 1G surface of the retainer 1 along two small edges thereof; similarly the work surface 1B integrates along a bottom edge with the bottom 1G surface thereby forming a unitary piece. The flanged rectangular surfaces 1A each have a single slot 1D for attachment of a first clip 2 or second clip 3 thereto. A horizontal slot 1D presents a horizontal adjustment for attachment of a bolt and wing nut combination through the clips 2, 3 (2C, slot in 3A) and retainer 1 thereby holding a longitudinal ladder member between the back of the work surface 1B and the two clips 2, 3. As these clips 2, 3 are adjustable using the slots in the flanged rectangular surfaces 1A, this thereby permits the attachment of the Ladder Shelf System to variously sized ladders.

Similarly, a vertical slot 1E is disposed underneath the horizontal slot 1D on either flanged rectangular edge 1A. These slots 1E are used to attach an elastic cord thereto so that an elastic cord having two hooks one at either end thereof is attached to the slots 1E thereby holding a one gallon paint can therewith. Alternatively, a raised protrusion 1H (not shown) is cut out of the material forming the slot 1E on either side of retainer 1 and is situated away from the center of the retainer 1. The hooks at either end of the elastic cord are each attached to one of these raised protrusions 1H whilst the cord itself grips the body of a paint can.

Slots 1F at the bottom 4B of the retainer 1 are for adjustable attachment of the retainer 1 to holes in the tray 4 using slot bolt nut combination fasteners as appropriate. The flanged rectangular edges 1A each also have a cutout 1C at its top edge that moves downwards then parallels the top edge. This cutout 1C is utilized to attach the wire handle of a one gallon paint can thereto. When a user places the one gallon paint can atop the bottom surface 1G of the retainer 1 or in the tray 4 it can move about as a user transits up and down or otherwise moves upon the ladder; therefore, the cutout 1C allows for the insertion of the wire handle of the paint can therein further stabilizing the can upon the retainer 1 bottom surface 1G.

The first clip 2 is a member having a first slotted piece 2A and an engagement portion 2B disposed approximately or at a right angle there between. The first slotted surface 2A has a cutout 2C therein for attachment of a bolt and wing nut combination so that this first clip 2 can be attached to a side horizontal slot 1D of a retainer 1. The engagement portion 2B has a longitudinal member 2F having a curved edge (used to support a top surface of a ladder rung or step that is curved) at its bottom side and an integral hook shape at its end opposite to the intersection between the engagement portion 2B and the first slotted piece 2A. The integral hook shape is formed by a vertically disposed lip 2D that is much smaller in height than the engagement portion 2B, and that has a deep cut 2E between this lip 2D and the engagement portion 2B. Finally, a bottom edge of the second slotted piece 3A sits in this deep cut 2E thereby providing holding power to the overall system to contain a ladder longitudinal member between these two clips 2, 3 and the back of the working surface 1B.

The second clip 3 is a member having a first rectangular piece 3B and a second slotted piece 3A disposed approximately or at a right angle there between. The second slotted surface 3A has a cutout therein for attachment of a bolt and wing nut combination so that this second clip 3 can be attached to a side horizontal slot 1D of a retainer 1.

Figure 4B:
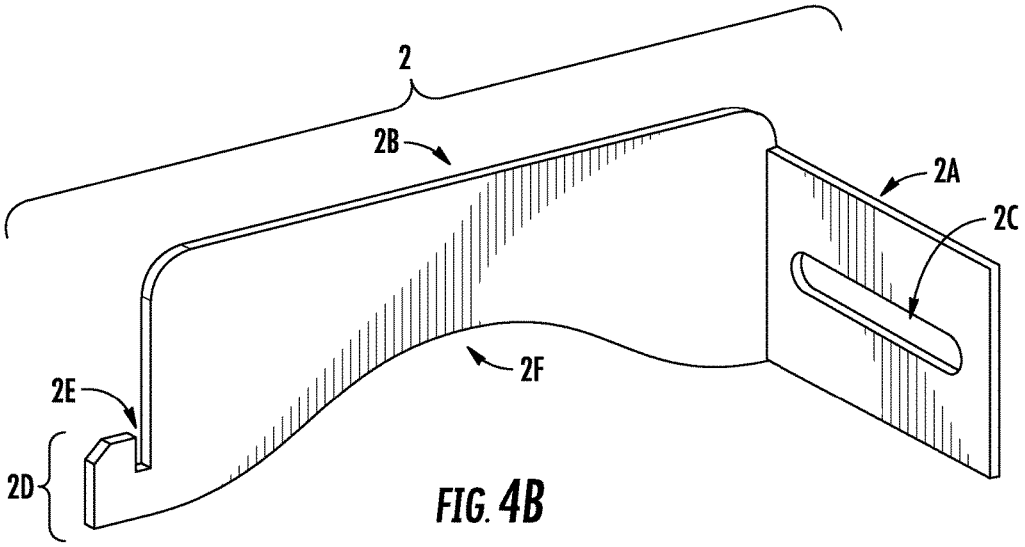
FIG. 4B presents an exploded view of a first clip in an embodiment disclosed herein.
Figure 4C:
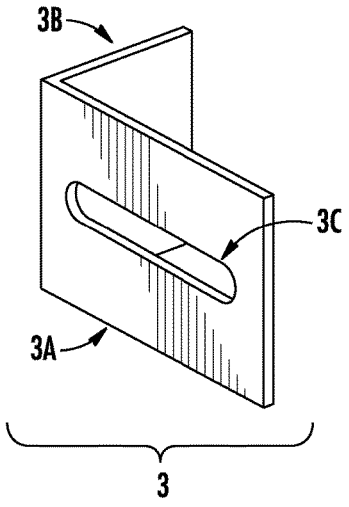
FIG. 4C presents an exploded view of a second clip in an embodiment disclosed herein.

FIG. 4B presents an exploded view of a first clip in an embodiment disclosed herein. The first clip 2 is a member having a first slotted piece 2A and an engagement portion 2B disposed approximately or at a right angle there between. The first slotted surface 2A has a cutout 2C therein for attachment of a bolt and wing nut combination so that this first clip 2 can be attached to a side horizontal slot 1D of a retainer 1. The engagement portion 2B has a longitudinal member 2F having a curved edge (used to support a top surface of a ladder rung or step that is curved) at its bottom side and an integral hook shape at its end opposite to the intersection between the engagement portion 2B and the first slotted piece 2A. The integral hook shape is formed by a vertically disposed lip 2D that is much smaller in height than the engagement portion 2B that has a deep cut 2E between this lip 2D and the engagement portion 2B. As described previously, a bottom edge of the second slotted piece 3A sits in this deep cut 2E thereby providing holding power to the overall system to container a ladder longitudinal member between these two clips 2, 3 and the back of the working surface 1B.

FIG. 4C presents an exploded view of a second clip in an embodiment disclosed herein. The second clip 3 is a member having a first rectangular piece 3B and a second slotted piece 3A disposed approximately or at a right angle there between. The second slotted surface 3A has a cutout therein for attachment of a bolt and wing nut combination so that this second clip 3 can be attached to a side horizontal slot of a retainer 1.

Figure 5:
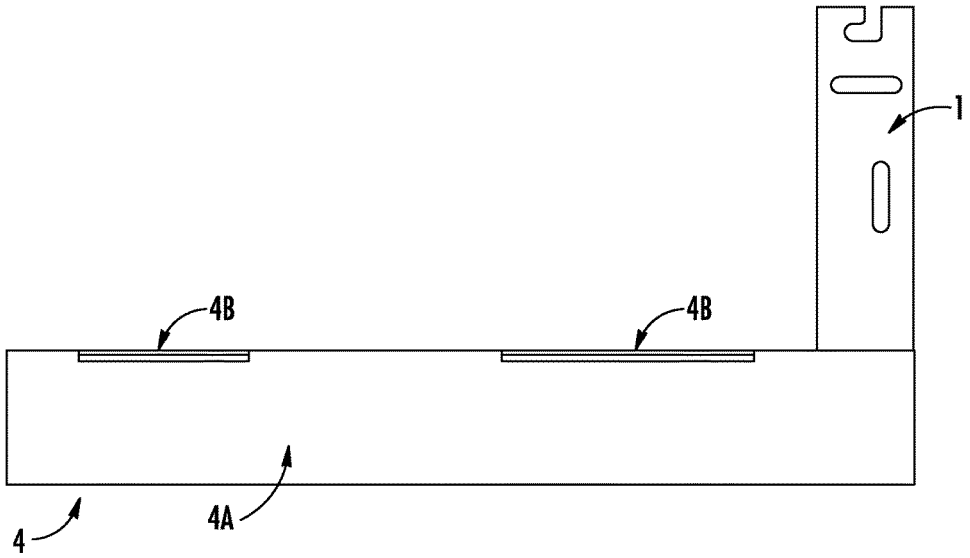
FIG. 5 presents a side view of the Ladder Shelf System with an inverted tray in an embodiment disclosed herein where the first and second clip are not shown.

FIG. 5 presents a side view of the Ladder Shelf System with an inverted tray in an embodiment disclosed herein where the first and second clip are not shown. As described with respect to FIG. 3, the tray 4 having various sides 4A is inverted so that two cutouts 4B are accessible for the physical support of the legs of a painting tray 5 therein.

Figure 6:
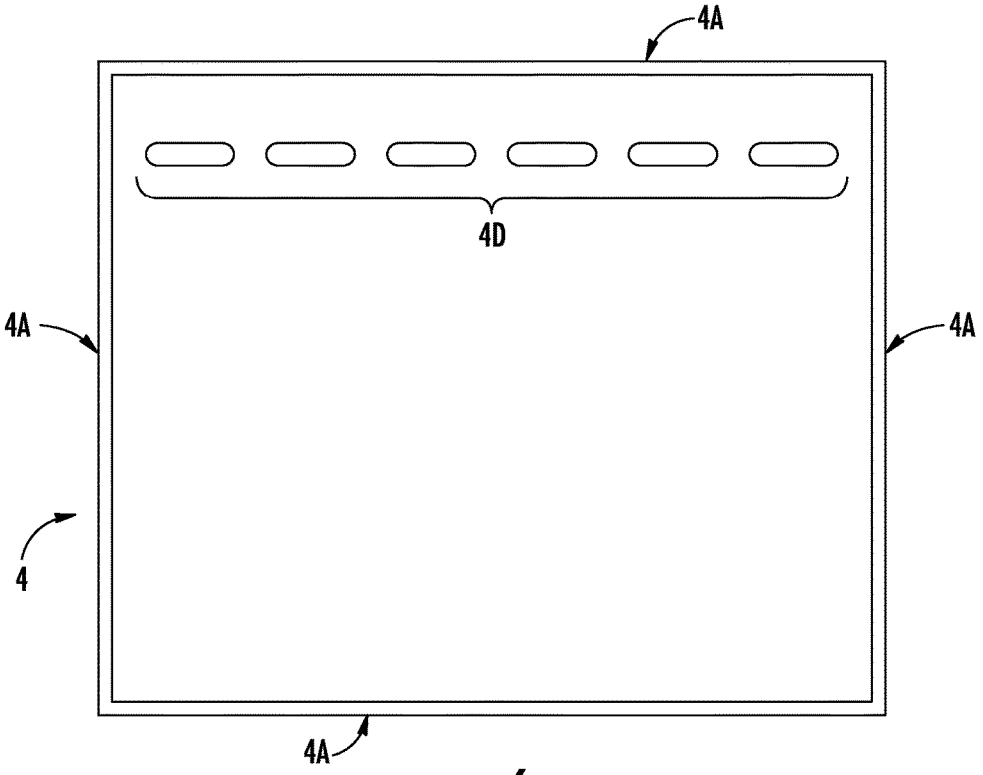
FIG. 6 presents a top view of a Ladder Shelf System tray in an alternative embodiment disclosed herein.

FIG. 6 presents a top view of a Ladder Shelf System tray in an alternative embodiment disclosed herein. The Ladder Shelf System tray 4 has four sides 4A as previously described along with a variety of holes or slots 4D linearly disposed along the floor 4C. These are used to attach the floor 4C to the bottom surface of the retainer 1 using slots therein.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed, but that the invention will include all the embodiments falling within the scope of the appended claims.

What is claimed is:

1. A carrying instrument comprising:
a paint can retainer having:
a work surface;
a first surface;
a second surface; wherein the first surface and second surface integrate with the work surface such that they are on opposite sides of the work surface;
a bottom surface integral with the work surface along a bottom edge of the work surface; wherein the bottom surface is integral with a first edge of the first surface and the bottom surface is integral with a second edge of the second surface;
such that a paint can space is formed between the first surface, the second surface, the work surface and the bottom surface; and wherein the work surface, bottom surface, first surface and the second surface partially enclose the paint can space;
a ladder holder attached thereto.

2. The carrying instrument of claim 1, further comprising:
a first tray removably attached to the bottom surface of the retainer; wherein the tray has a plurality of sides and a floor such that the plurality of sides are disposed about the floor forming a carrying space between the sides and atop the floor and wherein the floor of the tray is removably attached to the bottom surface.

3. The carrying instrument of claim 2, further comprising:
a second paint tray first leg slot in the first tray.

4. The carrying instrument of claim 3, further comprising:
a second paint tray second leg slot in the first tray.

5. The carrying instrument of claim 1, wherein the paint can retainer further comprises:
a first cord attachment slot in the first surface.

6. The carrying instrument of claim 5, wherein the paint can retainer further comprises:
a second cord attachment slot in the second surface.

7. The carrying instrument of claim 1, wherein the ladder holder further comprises:
a first L shaped member having a first retainer attachment point removably attached to the first surface of the retainer using the first retainer attachment point.

8. The carrying instrument of claim 7, wherein the ladder holder further comprises:
a second L shaped member having a second retainer attachment point removably attached to the second surface of the retainer using the second retainer attachment point.

9. The carrying instrument of claim 8, wherein the ladder holder further comprises:
the first L shaped member cooperating with the second L shaped member along an indentation near an end of a leg of the first L shaped member such that a bottom edge of the second L shaped member sits within the indentation.

10. The carrying instrument of claim 1, wherein the ladder holder
is attached to the first surface and the second surface such that a ladder holding space is formed between the ladder holder and the back of the working surface.

11. The carrying instrument of claim 1, wherein the ladder holder further comprises:
a first member removably attached to the first surface; and
a second member removably attached to the second surface so that the first member and the second member cooperate together wherein the first member has a curved ladder edge.

12. The carrying instrument of claim 1, wherein the ladder holder further comprises:
a first member having an integral first slotted piece and an integral engagement portion wherein the engagement portion has a hook for gripping:
a second member having a second slotted piece and another piece of material.

13. The carrying instrument of claim 1, wherein the paint can retainer further comprises:
a first paint can wire cutout at a top of the first surface.

14. The carrying instrument of claim 13, wherein the paint can retainer further comprises:
a second paint can wire cutout at a top of the second surface.

15. A painting portability system comprises:

a first holder attachment point in a first surface;

a second holder attachment point in a second surface;

a working surface integral with the first surface and with the second surface, wherein the first surface and the second surface are on opposite sides of the working surface;

a bottom surface integral with the first surface, the second surface and the working surface; and a ladder holder attached at the first holder attachment point and the second attachment point such that a ladder holding space is formed between a back of the working surface and the ladder holder, and wherein the first surface, the second surface, the bottom surface and the working surface are distinct from the ladder holder.

16. The painting portability system of claim 15, wherein the ladder holder further comprises:

a curved ladder top portion.

17. A painting carriage device comprising:

a paint can supporting retainer having:

a ladder gripping holder attached to a first surface and to a second surface of the retainer;

such that the first surface and the second surface are opposite one another and integral with a bottom surface along corresponding edges of the first surface with the bottom surface and of the second surface with the bottom surface; and wherein the first surface and the second surface are integral with a working surface along edges of: the first surface with the working surface, and of the second surface with the working surface;

wherein the bottom surface and the working surface are integral along a common edge such that a paint can space is formed between a front of the working surface and a top of the the bottom surface, and the paint can space is formed between the first surface and the second surface and atop the bottom surface; and wherein the working surface, bottom surface, first surface and the second surface partially enclose the paint can space.

18. The painting carriage device of claim 17, further comprising:

a support tray having a plurality of sides attached front to end one after another and wherein each of the plurality of sides is attached to a floor having a top of the floor and a bottom of the floor; such that the floor is directly attached to the bottom surface of the paint can supporting retainer.

19. The painting carriage device of claim 18, further comprising:

a paint tray leg first slot in the support tray such that the support tray when inverted is attached at the bottom of the support tray floor with a bottom surface of the retainer.

20. The painting carriage device of claim 17, further comprising:

a paint can wire cutout in the first surface.

* * * * *